United States Patent [19]

Fyson

[11] 4,294,914

[45] Oct. 13, 1981

[54] PHOTOGRAPHIC BLEACH COMPOSITIONS AND METHODS OF PHOTOGRAPHIC PROCESSING

[75] Inventor: John R. Fyson, London, England

[73] Assignee: Eastman Kodak Company, Rochester, N.Y.

[21] Appl. No.: 192,952

[22] PCT Filed: Sep. 14, 1979

[86] PCT No.: PCT/GB79/00152

§ 371 Date: May 14, 1980

§ 102(e) Date: May 2, 1980

[87] PCT Pub. No.: WO80/00624

PCT Pub. Date: Apr. 3, 1980

[30] Foreign Application Priority Data

Sep. 14, 1978 [GB] United Kingdom ..... 36816/78

[51] Int. Cl.[3] ..... G03C 5/32; G03C 5/38; G03C 5/44; G03C 5/52

[52] U.S. Cl. ..... 430/418; 260/429 J; 430/430; 430/460; 430/461; 430/462; 562/571

[58] Field of Search ..... 71/DIG. 2; 252/527, 252/546, 180, DIG. 11; 260/429 J; 562/571; 430/460, 461, 462, 418, 430

[56] References Cited

U.S. PATENT DOCUMENTS

| | | | |
|---|---|---|---|
| 2,240,957 | 5/1941 | Munz | 252/546 |
| 3,080,410 | 3/1963 | Le Blanc | 260/429 J |
| 3,241,966 | 3/1966 | Heilmann | 96/60 |
| 3,615,508 | 10/1971 | Stephen | 430/461 |
| 3,702,247 | 11/1972 | Williams | 430/460 |
| 3,767,401 | 10/1973 | Newman | 430/460 |
| 3,767,689 | 10/1973 | Donovan | 430/460 |
| 3,770,437 | 11/1973 | Brugger | 430/461 |
| 3,867,419 | 2/1975 | Iwano | 430/460 |
| 3,981,779 | 9/1976 | Block | 260/429 J |
| 4,017,596 | 4/1977 | Lo Berg | 562/571 |
| 4,033,771 | 7/1977 | Borton | 430/460 |
| 4,040,837 | 8/1977 | Sakamoto | 430/460 |
| 4,181,672 | 1/1980 | Popper | 562/571 |

FOREIGN PATENT DOCUMENTS

| | | |
|---|---|---|
| 866605 | 7/1949 | Fed. Rep. of Germany . |
| 1051117 | 2/1959 | Fed. Rep. of Germany . |
| 2602987 | 7/1976 | Fed. Rep. of Germany . |
| 1338856 | 10/1963 | France . |
| 2602987 | 5/1976 | France . |
| 1032024 | 4/1964 | United Kingdom . |
| 1200188 | 7/1970 | United Kingdom . |
| 1365453 | 9/1974 | United Kingdom . |
| 1392163 | 4/1975 | United Kingdom . |
| 1394357 | 5/1975 | United Kingdom . |

*Primary Examiner*—Dennis L. Albrecht
*Attorney, Agent, or Firm*—A. P. Lorenzo

[57] ABSTRACT

Photographic silver halide bleach compositions which are more active than existing bleach compositions and free from environmental and commercial objections thereto comprise as bleaching agent a ferric complex of an alkyliminodiacetic acid the alkyl group of which may be substituted. The bleach solutions may further comprise a silver halide solvent thus rendering them bleach-fix solutions.

15 Claims, 4 Drawing Figures

PHOTOGRAPHIC BLEACH COMPOSITIONS AND METHODS OF PHOTOGRAPHIC PROCESSING

Figure 1:
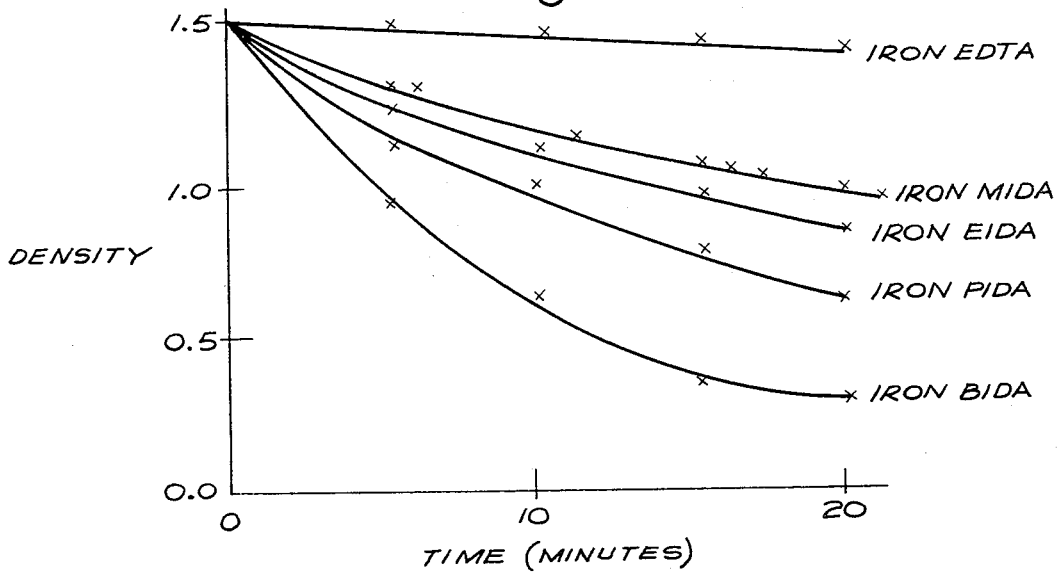

This invention relates to photographic bleach compositions and to methods of photographic processing employing such compositions.

Bleach baths are widely used in photographic color processing to remove image silver so that only dye image remains. In many instances it is convenient to use a combined bleach and fix bath and this is known as a bleach-fix bath.

Most conventionally used bleach baths are based on alkali metal ferricyanide because it gives the fastest and most effective bleaching. However ferricyanides are not used in commercial bleach-fix baths; they tend to employ ferric ions complexed with either ethylenediaminetetracetic acid (EDTA) or nitrilotriacetic acid (NTA) even though many other complexing agents have been proposed.

Ferric EDTA and NTA are not always suitable for bleach baths as they are slower than ferricyanide bleaches and not sufficiently strong to oxidize some image dyes leaving them in their less stroangly colored leuco form.

British Pat. No. 1,394,357 describes photographic bleach solutions which essentially contain a thioamide compound in addition to a ferric ion complex bleaching agent. On page 2 of the specification iminodiacetic acid (IDA) is listed as a possible complexing agent for the ferric ions.

Bleach-fix baths are also widely used in photographic color processing and, as their name suggests, combine the functions of a bleach and a fix bath. German Pat. No. 866,605 (published in 1953) describes bleach-fix baths in which the bleaching agent is a ferric complex of an organic acid of the general formula:

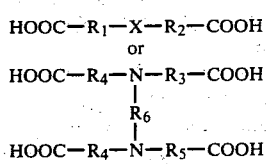

in which X represents

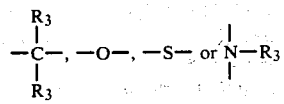

and $R_1$, $R_2$ and $R_3$ represent hydrocarbon radicals which may be substituted and $R_3$ may also represent hydrogen, and in which $R_4$, $R_5$ and $R_6$ represent bivalent hydrocarbon radicals which may again be substituted. Among the specific examples of such acids listed are EDTA, NTA and ethyliminodipropionic acid (EIDPA). Of all the organic acids specified in the German Specification only EDTA has been widely used in practice. The acid EIDPA is unattractive commercially as it is expensive to produce and not otherwise readily available.

There are environmental objections to both ferricyanides and ferric EDTA and NTA. The decomposition products of ferricyanide wastes can be toxic especially to fish. EDTA and NTA, if discharged into some environments which contain precipitated heavy metals, e.g. on sea beds or in lakes, can redissolve these heavy metals. The metals are then able to enter the food chain of aquatic animals.

The present invention provides photographic bleach compositions which are more active than ferric EDTA, NTA or IDA compositions and which are free from the environmental and commercial objections to the photographic bleaching agents mentioned above.

According to the present invention, there is provided a photographic bleach composition which comprises as bleaching agent a ferric complex of an alkyliminodiacetic acid the alkyl group of which may be substituted.

Alkyliminodiacetic acids are available commercially but may be prepared cheaply and easily by a method described for the preparation of methyliminodiacetic acid (MIDA) by G. J. Berchet found in Blatt, Organic Synthesis, Vol. 11 397–398 which is described in Example 2 below.

The present invention further provides a method of processing a photographic color material which comprises the steps of bleaching the material containing both a silver image and a dye image with a bleach composition according to the present invention and either simultaneously or subsequently fixing the material.

Any photographic silver halide emulsions may be used in the materials to be processed with the present bleach compositions. These emulsions may comprise silver chloride, silver bromide, silver bromoiodide, silver chlorobromide or mixtures thereof. Coarse grain or fine grain emulsions prepared by any of the well-known procedures may be used. The emulsions may contain any of the known chemical sensitizers, color couplers, spectral sensitizers, antifoggants, stabilizers, coating aids and other addenda used in photographic materials. The silver halide emulsions may contain a hydrophilic colloid, for example, gelatin, gelatin derivatives, cellulose derivatives, polysaccharides such as dextrose or gum arabic, or synthetic polymeric substances, for example, the water-soluble polyvinyl compounds, poly(vinylpyrrolidone) and acrylamide polymers.

The alkyliminodiacetic acids which may be employed herein preferably have an alkyl group having 1–6 carbon atoms. The substituent on the alkyl group (if present) may be, for example, a hydroxy group. Examples of particular alkyl and substituted alkyl groups which may be present on the alkyliminodiacetic acid are methyl, ethyl, n-propyl, n-butyl, n-amyl, hydroxyethyl and hydroxy-n-hexyl.

The ratio of alkyliminodiacetic acid to ferric ions in the present compositions may vary widely, for example from 1:1 to 15:1, optimally from 1:1 to 5:1 on a molar basis.

The present bleach compositions may also contain other bleaching agents, for example, ferric EDTA, or any of those listed in British Pat. No. 1,340,131 or U.S. Pat. No. 3,694,462, in addition to the bleaching agents specified above. The working strength bleach solutions may have a pH in the range 5 to 7 preferably pH 6.0 and will preferably contain a water-soluble halide, e.g., for color films, potassium bromide in a concentration of more than 40 g/liter, preferably from more than 60 g/liter up to the limit of solubility.

The present bleach solutions are more effective than ferric EDTA bleach solutions due to the higher oxidation potential of the ferric alkyliminodiacetic acid complex. Consequently either faster bleaching can be obtained from an equivalent solution or equivalent bleaching can be obtained from a solution containing less halide or bleaching agent. The present compositions may be stored in very concentrated solution, e.g. containing from up to 540 g/liter of bleaching agent, enabling kits of processing chemicals to be compact.

The present bleach solutions may contain a silver halide solvent, preferably an ammonium or alkali metal thiosulfate, in which case they become bleach-fix solutions.

Other silver halide solvents which may be used include thiocyanates, thioureas and thioethers, for example those mentioned in British Pat. No. 1,340,131.

The following Examples illustrate the invention. FIGS. 1 to 4 of the accompanying drawings illustrate the results.

EXAMPLE 1

A series of bleach solutions was prepared according to the following formulations:

0.02 M ferric chloride
0.1 M potassium bromide
0.25 M alkyliminodiacetic acid

The alkyl of the alkyliminodiacetic acid was methyl (MIDA), ethyl(EIDA), n-propyl (PIDA) or n-butyl (BIDA). These solutions were adjusted to pH 6.0 with ammonia and were used to bleach strips of exposed and developed medium speed black and white film, for varying times. After bleaching the strips were washed, fixed, washed and dried in the conventional manner. These strips were compared with strips bleached in a similar solution to the above except the alkyliminodiacetic acid was replaced with an equivalent molar concentration of EDTA. FIG. 1 shows the results.

EXAMPLE 2

To 2 moles of chloroacetic acid in 150 ml of water, were added 4 moles sodium hydroxide in 500 ml of water, the reaction mixture being cooled on ice and kept below 30° C. After this the ice bath was removed and 1 mole methylamine (as 30% aqueous solution) was added slowly. The solution temperature was not allowed to rise above 50° C. No further purification of the MIDA is essential although for a commercial bleach the chloride should preferably be removed to prevent corrosion of equipment.

Half the solution prepared above was added slowly to 110 g hydrated ferric nitrate dissolved in a small quantity of water. The solution was then buffered to pH 6.0 by adding ammonia solution. To this was added 50 g ammonium bromide and the solution was made up to 1 liter with water.

This solution was used as bleach in the C-41 process described in the *British Journal of Photography Annual* 1977 pages 204–5 and compared to the bleach employed therein in the processing of sensitometrically exposed medium speed color negative film. The control bleach had the formula:

| | |
|---|---|
| EDTA FeNa | 100 g |
| Potasssium bromide | 50 g |
| Ammonia 20% | 6 ml |
| Water to make | 1000 ml |
| (pH 5.9–6.1 | |

Figure 2:
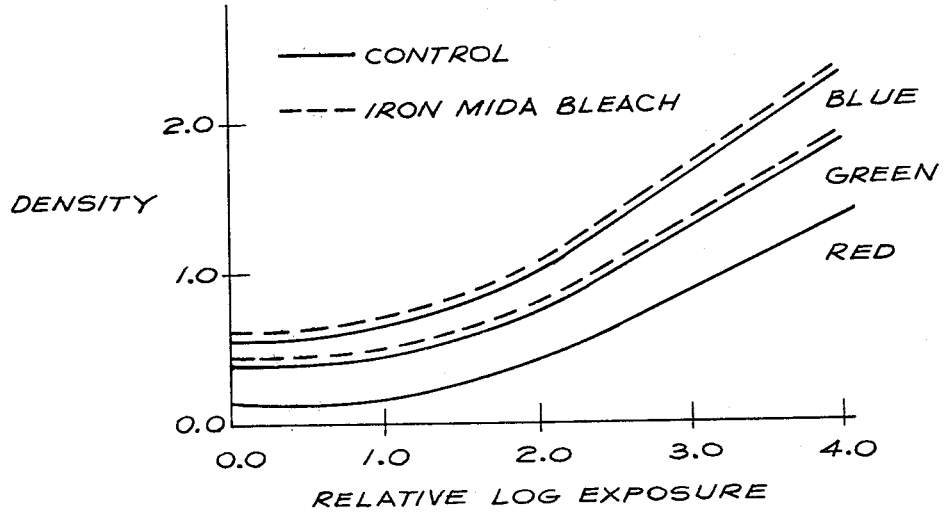

The results in the form of relative log exposure vs. density through blue, green and red filters are shown in FIG. 2. The two red filter curves are identical.

No silver was detected by X-ray fluorescence in either sensitometric step wedge although there is a slight increase in blue and green densities in the film bleached in iron (III) MIDA.

EXAMPLE 3

Figure 3:
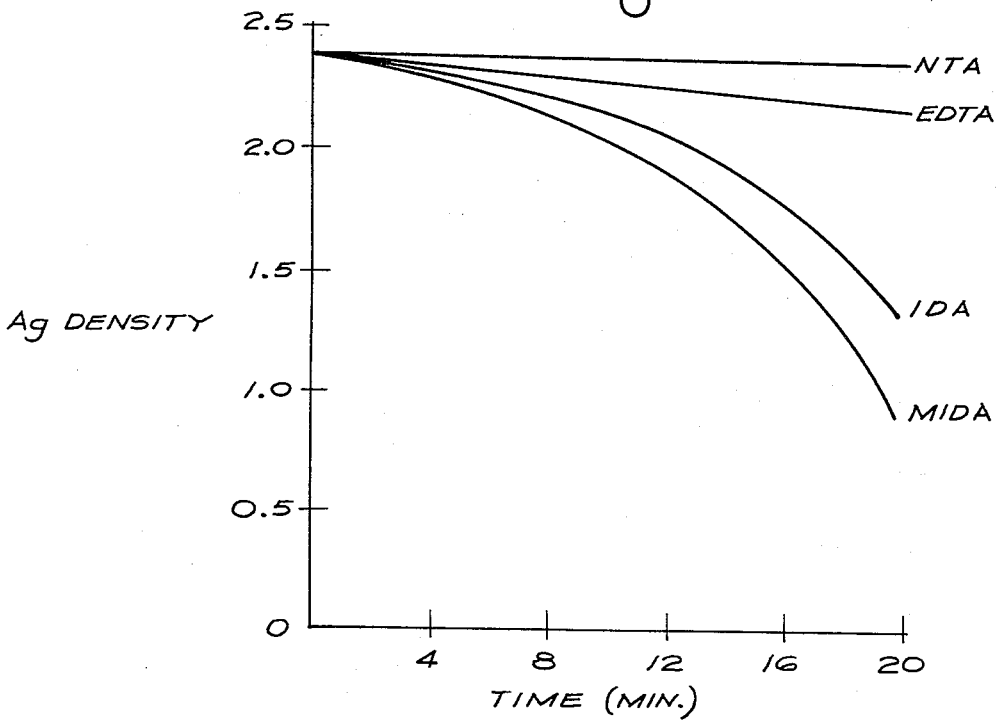

The photographic testing procedure of Example 1 using a black and white microfilm was repeated using a series of bleach solutions of the formula:

| | |
|---|---|
| 0.02M | ferric chloride |
| 0.1 M | potassium bromide |
| 0.25M | acid |
| | pH adjusted to 6.5 |

in which the acid was EDTA, NTA, IDA (iminodiacetic acid) (all comparative) or MIDA (the invention). The results are shown in FIG. 3.

EXAMPLE 4

The photographic testing procedure of Example 1 was repeated except that the bleach and fix solutions were replaced by a single bleach-fix solution of the formula:

| | |
|---|---|
| 0.25M | ferric chloride |
| 0.25M | acid |
| 0.62M | ammonium thiosulphate |
| | pH adjusted to 6.8 |

Figure 4:
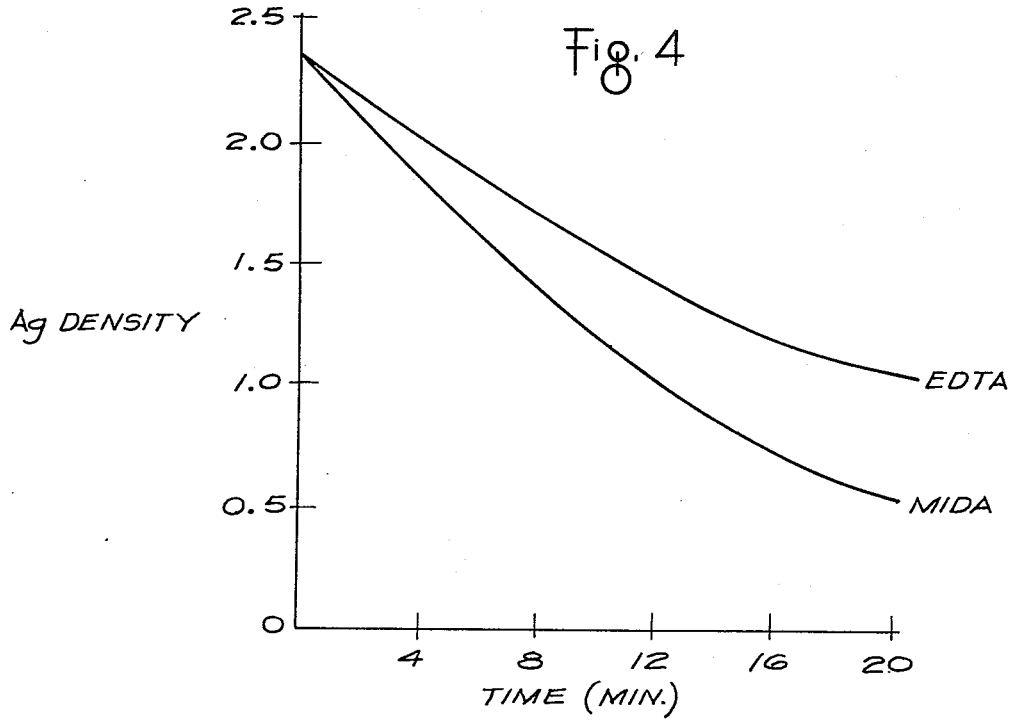

5 in which the acid was EDTA (comparative) or MIDA (invention). The results are shown in FIG. 4.

I claim:

1. A method of processing a photographic color material comprising the step of bleaching or bleach-fixing said material with a composition comprising, as the bleaching agent, a ferric complex of an alkyliminodiacetic acid, the alkyl group of which contains from 1 to 6 carbon atoms.

2. The method of claim 1 wherein said alkyliminodiacetic acid is selected from the group consisting of methyliminodiacetic acid, ethyliminodiacetic acid, n-propyliminodiacetic acid and n-butyliminodiacetic acid.

3. The method of claim 1 wherein the alkyl group of said alkyliminodiacetic acid is substituted with an hydroxy group.

4. The method of claim 1 wherein said complex has a ratio of alkyliminodiacetic acid to ferric ion of from 1:1 to 5:1 on a molar basis.

5. A method of bleaching a photographic color material which comprises contacting said material with an aqueous bleaching solution containing a water-soluble halide and, as the bleaching agent, a ferric complex of an alkyliminodiacetic acid, the alkyl group of which contains from 1 to 6 carbon atoms.

6. The method of claim 5 wherein said water-soluble halide is potassium bromide in an amount of at least 40 g/liter.

7. The method of claim 5 wherein said bleach solution has a pH in the range of 5 to 7.

8. A method of bleach-fixing a photographic color material which comprises contacting said material with an aqueous bleach-fixing solution containing a sufficient concentration of a silver halide solvent to act as a fixing agent and, as the bleaching agent, a ferric complex of an alkyliminodiacetic acid, the alkyl group of which contains from 1 to 6 carbon atoms.

9. The method of claim 8 wherein said silver halide solvent is an ammonium or alkali metal thiosulfate.

10. An aqueous photographic bleaching solution containing a water-soluble halide and, as the bleaching agent, a ferric complex of an alkyliminodiacetic acid, the alkyl group of which contains from 1 to 6 carbon atoms.

11. The bleaching solution of claim 10 wherein said alkyliminodiacetic acid is selected from the group consisting of methyliminodiacetic acid, ethyliminodiacetic acid, n-propyliminodiacetic acid and n-butyliminodiacetic acid.

12. A photographic bleaching solution comprising an aqueous solution of a ferric complex of methyliminodiacetic acid and potassium bromide.

13. An aqueous photographic bleach-fixing solution containing a sufficient concentration of a silver halide solvent to act as a fixing agent and, as the bleaching agent, a ferric complex of an alkyliminodiacetic acid, the alkyl group of which contains from 1 to 6 carbon atoms.

14. The bleach-fixing solution of claim 13 wherein said alkyliminodiacetic acid is selected from the group consisting of methyliminodiacetic acid, ethyliminodiacetic acid, n-propyliminodiacetic and n-butyliminodiacetic acid.

15. A photographic bleach-fixing solution comprising an aqueous solution of a ferric complex of methyliminodiacetic acid and an ammonium or alkali metal thiosulfate.

* * * * *